US006312536B1

(12) United States Patent
Omiya et al.

(10) Patent No.: US 6,312,536 B1
(45) Date of Patent: Nov. 6, 2001

(54) HOT-DIP GALVANIZED STEEL SHEET AND PRODUCTION THEREOF

(75) Inventors: Yoshinobu Omiya; Takaaki Tamura, both of Kakogawa (JP)

(73) Assignee: Kabushiki Kaisha Kobe Seiko Sho, Kobe (JP)

( * ) Notice: Subject to any disclaimer, the term of this patent is extended or adjusted under 35 U.S.C. 154(b) by 0 days.

(21) Appl. No.: 09/563,207

(22) Filed: May 2, 2000

(30) Foreign Application Priority Data

May 28, 1999 (JP) ..... 11-148979

(51) Int. Cl.[7] ..... C21D 9/48; C21D 8/02; C22C 38/00

(52) U.S. Cl. ..... 148/533; 148/320; 148/333; 428/659

(58) Field of Search ..... 148/533, 320, 148/333; 428/659

(56) References Cited

U.S. PATENT DOCUMENTS

| | | | |
|---|---|---|---|
| 3,097,294 | 7/1963 | Kubli et al. | 219/145 |
| 4,264,684 | 4/1981 | Allegra et al. | 428/653 |
| 5,069,981 | 12/1991 | Oishi et al. | 428/659 |
| 5,156,690 | 10/1992 | Asano et al. | 428/659 |
| 5,433,796 | 7/1995 | Isobe et al. | 148/220 |

FOREIGN PATENT DOCUMENTS

| | | |
|---|---|---|
| 825 411 | 12/1959 | (GB) . |
| 4-26744 | 1/1992 | (JP) . |
| 4-128320 | 4/1992 | (JP) . |
| 4-128321 | 4/1992 | (JP) . |
| 4-173945 | 6/1992 | (JP) . |
| 5-331537 | 12/1993 | (JP) . |
| 9-25537 | 1/1997 | (JP) . |
| 9-263883 | 10/1997 | (JP) . |
| wo 98/02589 | 1/1998 | (WO) . |
| WO 00/08221 | 2/2000 | (WO) . |

*Primary Examiner*—Roy King
*Assistant Examiner*—Nicole Coy
(74) *Attorney, Agent, or Firm*—Oblon, Spivak, McClelland, Maier & Neustadt, P.C.

(57) ABSTRACT

A hot-dip galvanized steel sheet having both high strength and good formability. A process for producing said hot-dip galvanized steel sheet without requiring additional steps of surface grinding and pre-plating.

The hot-dip galvanized steel sheet is produced by forming a hot-dip galvanizing layer on a base cold-rolled steel sheet composed of C (0.02–0.20 mass %), Mn (1.50–2.40 mass %), Cr (0.03–1.50 mass %), Mo (0.03–1.50 mass %), 3Mn+6Cr+Mo (no more than 8.1 mass %), Mn+6Cr+10 Mo (no less than 3.5 mass %), Al (0.010–0.150 mass %), and Fe as the principal component, with Ti limited to 0.01 mass % or less, Si limited to 0.04 mass % or less, P limited to 0.060 mass % or less, and S limited to 0.030 mass % or less, and said base steel sheet having the composite microstructure composed mainly of ferrite and martensite.

5 Claims, 2 Drawing Sheets

HOT-DIP GALVANIZED STEEL SHEET AND PRODUCTION THEREOF

BACKGROUND OF THE INVENTION

1. Field of the Invention

The present invention relates to a high-strength hot-dip galvanized steel sheet (including hot-dip galvannealed steel sheet) having a tensile strength of about 440–780 N/mm$^2$ which is superior in formability and platability.

2. Description of the Related Art

The structural member of automobiles is made of steel sheet for absorption of impact energy. High-strength steel sheet for this purpose has been adopted for safety improvement and weight reduction (for improved fuel efficiency and environmental protection). Unfortunately, increase in strength leads to decrease in formability (or difficulties in press forming). Thus there has been a strong demand for steel sheets which meet requirements for both strength and formability.

Such steel sheets are disclosed in Japanese Patent Laid-open Nos. 26744/1992, 128320/1992, 128321/1992, 173945/1992, 331537/1993, 25537/1997, and 263883/1997. They include high-strength steel sheets having a high value of elongation due to deformation induced transformation of retained austenite, and they also include hot-dip galvanized steel sheets and hot-dip galvannealed steel sheets whose base metal has structure strength owing to the hard phase of martensite. They have been widely used as automotive steel sheets superior in corrosion resistance.

However, the prior art technology still has room for improvement. According to Japanese Patent Laid-open No. 26744/1992 mentioned above, the high-strength steel sheet with a high value of elongation is obtained by forming retained austenite in the hot-dip galvanizing line. It is poor in platability due to its high silicon content. In fact, this drawback has to be remedied by additional steps such as surface grinding and pre-plating, as illustrated in some examples. According to Japanese Patent Laid-open No. 331537/1993, the steel sheet has the composite structure of ferrite and martensite. This steel sheet is positively incorporated with Si and Mn for improvement in quench-hardenability. Si and Mn adversely affect platability, and this drawback has to be remedied by additional steps such as pre-plating. It is very difficult to make formability and platability compatible with each other. This difficulty has been overcome by carrying out additional steps such as surface grinding and pre-plating.

According to Japanese Patent Laid-open Nos. 128320/1992 and 128321/1992, the high-strength steel sheet with a high value of elongation is obtained by rapid cooling (which gives rise to a composite structure) in the hot-dip galvanizing line. The steel sheet is incorporated with silicon which concentrates carbon in austenite for improvement in quench-hardenability through martensitic transformation. (The amount of silicon is 0.17–0.20% in Examples.) Incorporation with an excess amount of silicon causes poor plating in alloying treatment (as mentioned in the documents). It is necessary to strictly control the amount of silicon (0.17–0.20%) so as to avoid surface defects (called bare-spot) due to wettability of molten zinc.

The steel sheet according to Japanese Patent Laid-open No. 173945/1992 has the composite structure of bainite-ferrite-martensite (with bainite being the major component). The disclosed technology requires the steel sheet to be incorporated with silicon for improvement in ferrite ductility by transfer of carbon into the austenitic phase. Incorporation with silicon produces the same adverse effect as mentioned above. The steel sheet incorporated with silicon is superior in local deformation such as bending but is poor in elongation because its structure is composed mainly of bainite which is a comparatively soft phase occurring by transformation at a low temperature.

Japanese Patent Laid-open Nos. 25537/1997 and 263883/1997 are concerned with the technology for a high-strength hot- and cold-rolled steel sheet which is composed of ferrite, martensite, tempered martensite, and lower bainite. This steel sheet needs a certain amount of titanium incorporated therein so that it has good resistance to pitting corrosion. Unfortunately, titanium forms coarse nitrides in steel, adversely affecting the local deforming performance. It also decreases the amount of carbon necessary to form carbides and to form the phase which undergoes transformation at a low temperature. Another disadvantage is an adverse effect on alloying at the time of plating, which hinders stable production.

OBJECT AND SUMMARY OF THE INVENTION

The present invention was completed in view of the foregoing. It is an object of the present invention to provide a hot-dip galvanized steel sheet and a process for production thereof. The steel sheet has a high strength and is superior in both formability and platability. The process permits the steel sheet to be produced without additional steps of surface grinding and pre-plating.

DESCRIPTION OF THE PREFERRED EMBODIMENTS

Figure 1:
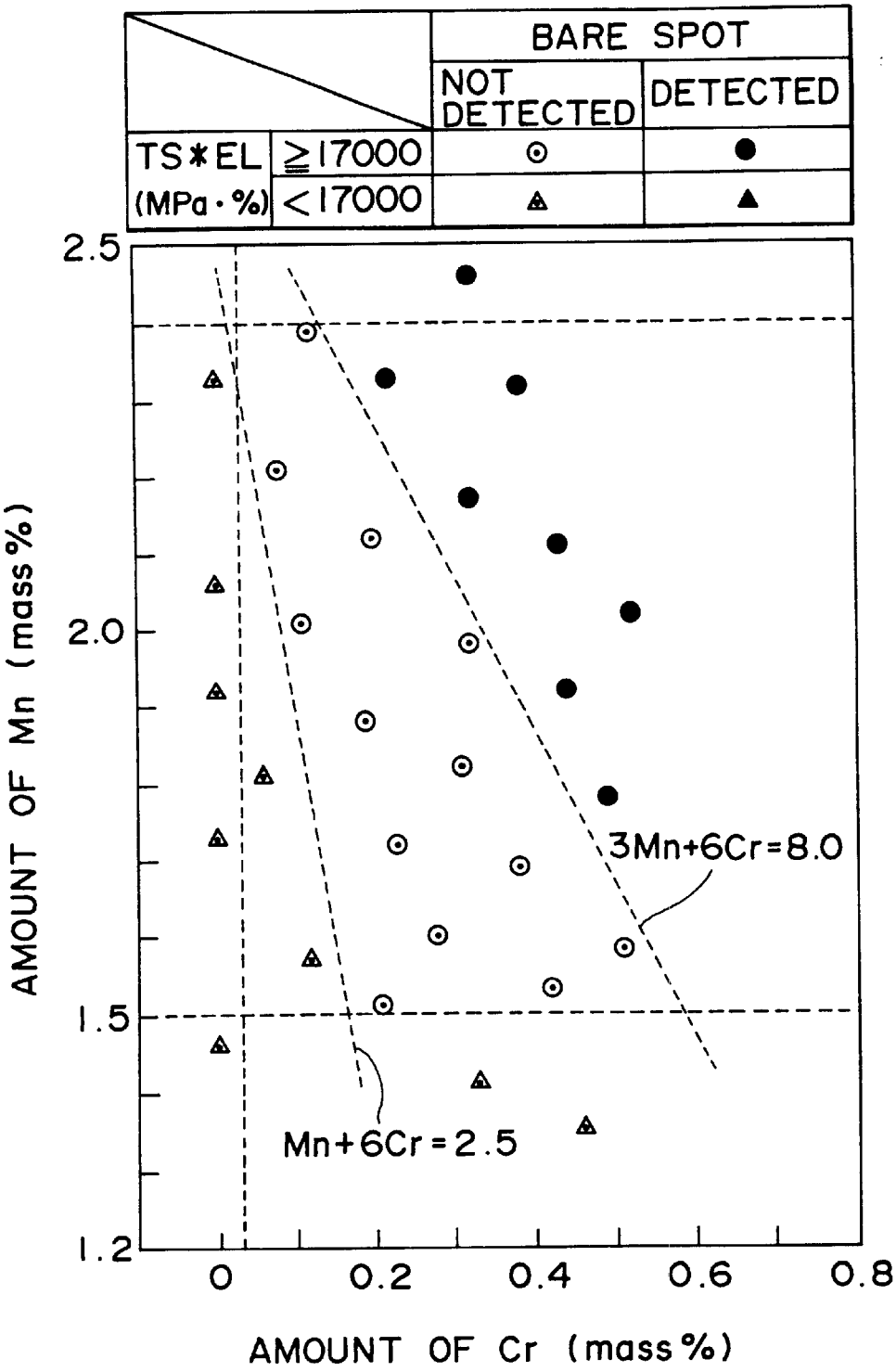
FIG. 1 is a diagram showing how the strength-ductility balance and the platability depend on the amount of Cr and the amount of Mn in Example 1.

The gist of the present invention resides in a hot-dip galvanized steel sheet which is composed of a base steel sheet and a layer of hot-dip galvanizing formed thereon, said base steel sheet being composed of C (0.02–0.20 mass %), Mn (1.50–2.40 mass %), Cr (0.03–1.50 mass %), Mo (0.03–1.50 mass %), 3Mn+6Cr+Mo (no more than 8.1 mass %), Mn+6Cr+10Mo (no less than 3.5 mass %), Al (0.010–0.150 mass %), and Fe as the principal component, with Ti limited to 0.01 mass % or less, Si limited to 0.04 mass % or less, P limited to 0.060 mass % or less, and S limited to 0.030 mass % or less, and said base steel sheet having the composite structure composed mainly of ferrite and martensite.

According to the present invention, the dip-coat galvanized steel sheet is formed from a base cold-rolled steel sheet having the chemical composition (in mass %) specified above. The amount of each component is limited for the following reasons.

C: 0.02–0.20 mass %

Carbon greatly affects the strength of steel. It also changes the amount and morphology of the product formed by transformation at a low temperature, thereby affecting the elongation and stretch-flangeability. With an amount less than 0.02 mass %, carbon does not produce a strength greater than 440 N/mm$^2$. With an amount in excess of 0.20 mass %, carbon adversely affects weldability. The lower limit of carbon should be 0.02 mass %, preferably 0.04 mass %, and the upper limit of carbon should be 0.20 mass %, preferably 0.15 mass %.

Mn: 1.50–2.40 mass %

Manganese stabilizes austenite and changes the amount of carbon dissolved in austenite. It greatly affects the characteristic properties of the product formed by transformation at a low temperature in the cooling process. In the present invention, manganese is added for the product formed by transformation at low temperatures. In the present invention, the product means martensite. For the resulting high-strength steel sheet to have very good formability, it is necessary to add manganese in an amount of at least 1.50 mass %. Manganese in excess of 2.40 mass % presents difficulties in steel making and adversely affects weldability. Therefore, the upper limit of manganese should be 2.40 mass %.

Mo: 0.03–1.50 mass %

Cr: 0.03–1.50 mass %

According to the present invention, the steel is incorporated with Cr and Mo together. Manganese is also basically an element to improve quench-hardenability. These elements concentrate carbon in austenite, increases stability, and help the formation of martensite. In addition, they form their oxides on the surface of the steel plate, thereby affecting platability. When Cr, Mo, and Mn are added together, they synergistically improve both formability and platability (although the mechanism is not known very well). With an amount less than 0.03 mass % each, Mo and Cr do not improve quench hardenability. With an amount in excess of 1.50 mass % each, Mo and Cr do not produce any additional effect but increase production cost. Therefore, the amount of Mo and Cr should be from 0.03 mass % (the lower limit) to 1.50 mass % (the upper limit).

3Mn+6Cr+Mo: no more than 8.1 mass %

Mn+6Cr+10Mo: no less than 3.5 mass %

(The symbol of element denotes the amount of the element.)

Cr, Mo, and Mn should be added in an adequate ratio, as explained later in Examples. For the steel to undergo efficient martensitic transformation and to have a composite structure suitable for working, the amount of Mn+6Cr+10Mo should be no less than 3.5 mass %, preferably no less than 5.0 mass %. With an amount less than 3.5 mass %, these elements cause bainite (a soft product formed by transformation at a low temperature) to be formed excessively. Therefore, the resulting steel lacks good strength-elongation balance. On the other hand, for good platability, the amount of Mn+6Cr+10Mo should be no more than 8.1 mass %, preferably no more than 7.0 mass %. With an amount in excess of 8.1 mass %, these elements form oxides on the surface of the steel sheet, and these oxides prevent hot-dip galvanizing, giving rise to pinhole-like non-plated parts (bare spot). This greatly aggravates the appearance of the steel sheet.

Al:0.010–0.150 mass %

Aluminum should be added in an amount no less than 0.010 mass % for deoxidation. An excess amount adds to production cost and deteriorates the surface state. Therefore, the upper limit should be 0.150 mass %.

According to the present invention, the base cold-rolled steel sheet is composed of main components which include Fe and the above-mentioned basic components. The main components may also include inevitable impurities and any other elements having no adverse effect on the functions of the basic components and the characteristic properties of the steel sheet. Thus the main components may be supplemented with either or both of B and Ca as follows.

(1) Main components+B (2) Main components+Ca, or (1)+Ca

B: no more than 0.0050 mass %

Boron improves weldability and quench-hardenability. For boron to fully produce its effect, boron should be added in an amount no less than 0.0005 mass %. However, an excess amount does not produce additional effect but aggravates ductility and formability. Therefore, the upper limit should be 0.0050 mass %, preferably 0.0030 mass %. Ca:no more than 0.0050 mass %

Calcium controls the form of inclusions, thereby improving ductility and formability. For calcium to fully produce its effect, calcium should be added in an amount no less than 0.0010 mass %. However, an excess amount does not produce additional effect but increases the amount of inclusions in the steel, thereby aggravating ductility and formability. Therefore, the upper limit should be 0.0050 mass %, preferably 0.0040 mass %.

According to the present invention, it is necessary to limit the amount of specific elements (Ti, Si, P, and S) in inevitable impurities so as to achieve the object of the present invention. The reasons for limiting the amount of these elements are explained in the following.

Silicon forms an oxide layer on the surface of the steel sheet, thereby greatly aggravating the wettability of plating. Therefore, it is not added intentionally to the steel sheet of the present invention. However, when it is present in inevitable impurities, its amount should not exceed 0.04 mass %, preferably 0.02 mass %. Phosphorus causes uneven plating or makes alloying difficult if it is present in an amount in excess of 0.060 mass %. Therefore, the amount of phosphorus in inevitable impurities should not exceed 0.060 mass %, preferably 0.030 mass %. Sulfur in steel is fixed as it forms precipitates. However, it has an adverse effect on elongation and stretch-flangeability. Therefore, the amount of sulfur in inevitable impurities should not exceed 0.030 mass %, preferably 0.015 mass %.

Titanium forms carbide and nitride, thereby aggravating the local deforming performance and preventing the desired transformation. In addition, it remarkably promotes the alloying of hot-dip galvanizing. Titanium in an excess amount brings about excessive alloying and also brings about powdering and flaking at the time of steel sheet forming. (Flaking is a phenomenon due to the hard, brittle gamma phase which occurs in the interface between the underlying steel and the plating layer, and flaking causes the plating layer to peel off.) Therefore, the amount of titanium should be strictly controlled. The upper limit should be 0.01 mass %.

The base cold-rolled steel sheet used in the present invention has a composite structure composed mainly of ferrite and martensite. This composite structure is obtained in the following manner. A cold-rolled steel sheet having the above mentioned chemical composition is annealed before plating so that it has a structure composed of ferrite and austenite. After plating or alloying treatment, the steel sheet is cooled to the Ms point (martensite transformation starting temperature) or below at an average cooling rate greater than 5° C./sec. The above-mentioned composite structure should be composed mainly of ferrite and martensite such that other structures composed of pearlite, bainite, etc. account for less than 5%, preferably less than 3%, in terms of area ratio. Incidentally, the above-mentioned chemical composition contains 50–95% of ferrite and 5–50% of martensite. Therefore, the resulting steel sheet has both good formability and good platability.

If the microstructure is adjusted such that the ferrite phase has an area ratio exceeding 70%, then the resulting steel sheet has a very good balance between strength and elongation. If the amount of ferrite exceeds 80%, the resulting steel sheet improves in local deformation performance and has a good balance between strength and hole expanding properties. The hole expanding property is evaluated by method of hole expanding test: JFST 1001–1996 in the Japan Iron and Steel Federation Standard.

According to the present invention, the hot-dip galvanized steel sheet is produced by casting into a slab of steel having the chemical composition mentioned above, hot-rolling the slab, coiling the hot-rolled steel sheet at a temperature not higher than 700° C., performing optional pickling on the hot-rolled steel sheet, cold-rolling the hot-rolled steel sheet, performing isothermal treatment on the cold-rolled steel sheet at a temperature higher than $A_{c1}$ point in a continuous hot-dip galvanizing line, cooling the treated steel sheet to the plating bath temperature at an average cooling rate greater than 1° C./sec, performing hot-dip galvanizing and optional alloying treatment, and cooling the galvanized steel sheet at an average cooling rate greater than 5° C./sec.

In the present invention, hot-rolling may be carried out in the usual way. A desirable way of hot-rolling is such that the slab is heated at 1000–1300° C. so as to ensure the finishing temperature and to prevent austenite graines from becoming coarse. The finishing temperature of hot-rolling should be 800–950° C. so as to avoid the texture detrimental to formability. The cooling rate after finish rolling should be 30–120° C./sec so as to suppress the formation of pearlite. The coiling temperature not higher than 700° C. is specified because the steel sheet has thick scaling detrimental to pickling if the steel sheet is coiling at a temperature higher than 700° C. The lower limit of the coiling temperature is not specified. However, an excessively low coiling temperature results in a hard steel sheet which is poor in cold-rollability. Therefore, the lower limit should be 250° C., preferably 400° C.

Hot rolling should be followed by picking and cold rolling in the usual way. The ratio of cold rolling should be no less than 30%. If the ratio of cold rolling is less than 30%, it is necessary to produce a thin, long hot-rolled steel sheet (which decreases the efficiency of pickling) in order to obtain the desired product.

After cold-rolling, the steel sheet is kept heated at a temperature higher than $A_{c1}$ point prior to plating in the continuous hot-dip galvanizing line. In order to obtain the desired microstructure and achieve stable formability, it is necessary to heat the steel sheet at 780° C. or above, which is higher than the $A_{c1}$ point by about 50° C. The upper limit is not specifically restricted. Temperatures lower than 900° C. will not pose any problems. Heating should be continued for more than 10 seconds so as to obtain the desired microstructure of ferrite+austenite.

After isothermal treatment, the steel sheet is cooled to the plating bath temperature (usually 440–470° C.) at an average cooling rate greater than 1° C./sec. Then the steel sheet undergoes plating. If the cooling rate is lower than 1° C./sec, pearlite occurs which remains in the final structure. Hence the resulting steel sheet is poor in formability. The lower limit of the cooling rate after isothermal treatment should be 1° C./sec, preferably 5° C./sec. The upper limit of the cooling rate is not specifically restricted. It may be 50° C./sec so that the plate temperature can be controlled easily and the installation cost is adequately saved. In the case where alloying treatment is carried out, the steel sheet should be heated to 500–750° C. in the usual way after plating. After plating (if alloying treatment is not carried out) or after alloying treatment (if alloying treatment is carried out), the steel sheet should be cooled to room temperature at a cooling rate greater than 5° C./sec. Cooling in this way transforms austenite into martensite, giving rise to the microstructure composed mainly of ferrite and martensite. If the cooling rate is smaller than 5° C./sec, cooling gives rise to pearlite and bainite. Therefore, the lower limit of the cooling rate should be 5° C./sec, preferably 10° C./sec.

EXAMPLE 1

A steel of the following composition (as base components), incorporated with Mn and Cr in varied amounts, was prepared. Themolten steel was cast into a slab, which was heated to 1150° C. The heated slab was hot-rolled to a thickness of 2.6 mm, with the finish temperature being 870–900° C. The hot-rolled steel sheet was cooled at an average cooling rate of 40° C./sec and coiling at 480° C. After pickling, the steel sheet was cold-rolled to a thickness of 1.4 mm with a draught of 46%. The cold-rolled steel sheet underwent isothermal treatment at 800° C. for 20 sec. The heated steel sheet was cooled at an average cooling rate of 15° C./sec and then passed through a hot-dip galvanizing bath at 460° C. The galvanized steel sheet was cooled to room temperature at a cooling rate greater than 25° C./sec. Finally, the steel sheet underwent temper rolling with a draught of 0.8%. Thus there was obtained a hot-dip galvanized steel sheet as desired.

Base components (in mass %, with the remainder being substantially Fe)

C: 0.06%, Si: 0.01%, P: 0.010%,
S: 0.001%, Al: 0.030%, Mo: 0.10%

The hot-dip galvanized steel sheet was examined for microstructure (kind and area %) at the center of the thickness of the base steel sheet, by using a scanning electron microscope (×1000). The area % was calculated as an average of 20 fields. Specimens conforming to JIS No. 5 were taken, and they were tested for tensile strength (TS) and elongation (El). The strength-ductility balance (TS×El) was calculated. Nonplating parts were visually inspected. The test results are shown in FIG. 1.

It is noted from FIG. 1 that those steel sheets having the components within the range (between oblique lines) of the present invention are superior in mechanical properties (TS×El) and free from non-plating parts. By contrast, those steel sheets having the components outside the range of the present invention are poor in mechanical properties and/or have nonplating parts. Incidentally, it was found that the steel sheet composed of the components specified in the present invention has the dual-phase structure (ferrite plus martensite), with the amount of martensite being 13–24 area %.

EXAMPLE 2

A steel of the following composition (as base components), incorporated with Mo and Cr in varied amounts, was prepared. The steel was made into a cold-rolled steel sheet in the same way as in Example 1. The cold-rolled steel sheet underwent isothermal treatment at 810° C. for 60 sec. The heated steel sheet was cooled at an average cooling rate of 30° C./sec and then passed through a hot-dip galvanizing bath at 460° C. The galvanized steel sheet was cooled to normal temperature at a cooling rate greater than 15° C./sec. Finally, the steel sheet underwent temper rolling with a draught of 0.5%. Thus there was obtained a hot-dip galvanized steel sheet as desired. Base components (in mass %, with the remainder being substantially Fe)

C: 0.04%, Si: 0.01%, Mn: 1.6%,
P: 0.005%, S: 0.003%, Al: 0.020%

The hot-dip galvanized steel sheet was tested for the strength-ductility balance (TS×El) and non-plating parts in the same way as in Example 1. The results are shown in FIG. 2.

Figure 2:
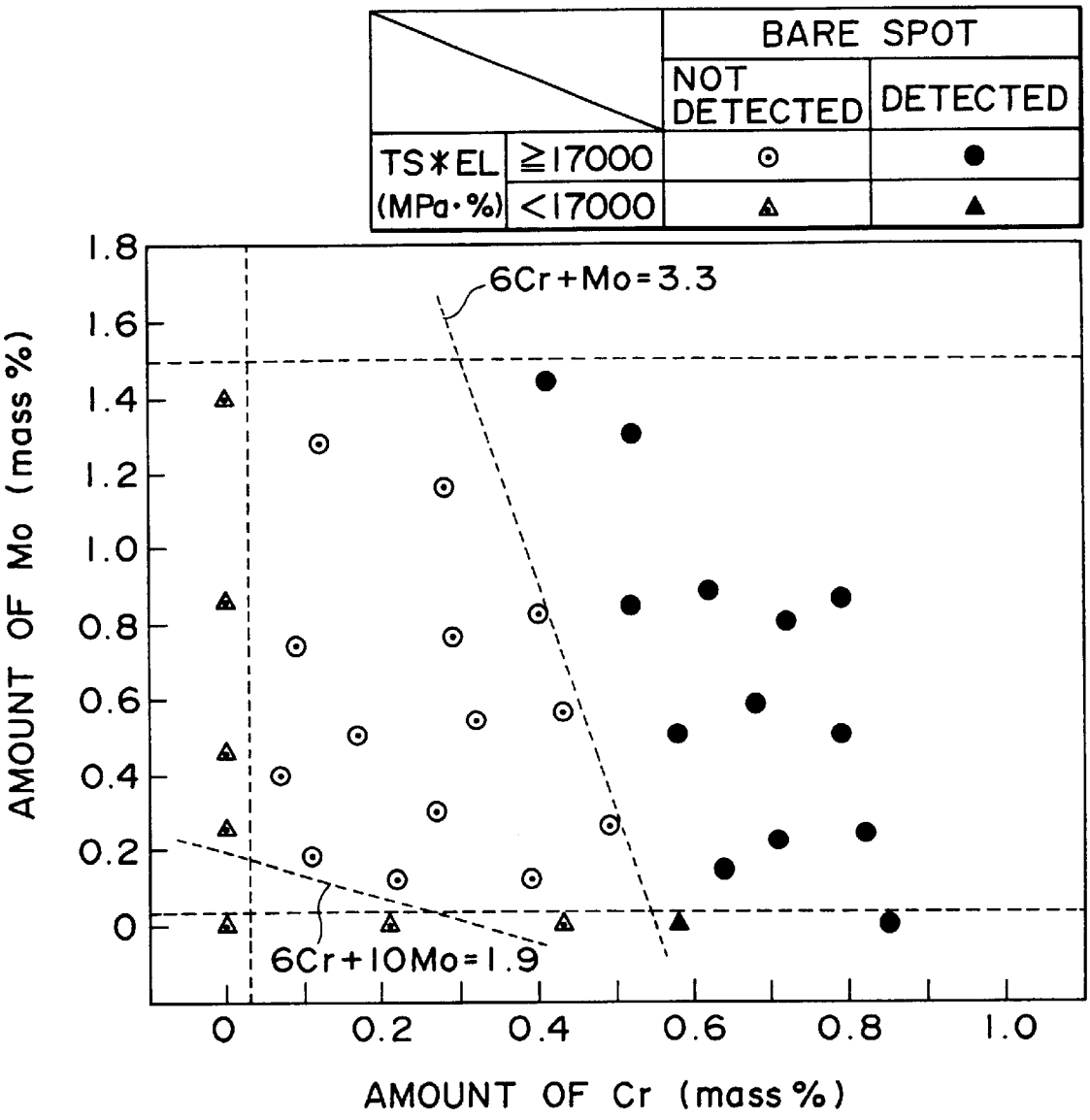
FIG. 2 is a diagram showing how the strength-ductility balance and the platability depend on the amount of Cr and the amount of Mo in Example 2.

It is noted from FIG. 2 that those steel sheets having the components within the range (between oblique lines) of the present invention are superior in mechanical properties (TS×El) and free from non-plating parts. By contrast, those steel sheets having the components outside the range of the present invention are poor in mechanical properties and/or have non-plating parts. Incidentally, it was found that the steel sheet composed of the components specified in the present invention has the dual-phase structure (ferrite plus martensite), with the amount of martensite being 8–16 area %.

A steel having the chemical composition shown in Table 1 was prepared, and the steel was made into a cold-rolled steel sheet in the same way as in Example 1. The cold-rolled steel sheet underwent isothermal treatment at 830° C. for 40 sec. The heated steel sheet was cooled at an average cooling rate of 25° C./sec and then passed through a hot-dip galvanizing bath at 460° C. Steel sheets (sample Nos. 1 and 2) underwent alloying treatment at 550° C. The galvanized steel sheet was cooled to room temperature at a cooling rate greater than 30° C./sec. Finally, the steel sheet underwent temper rolling with a draught of 1.0%. Thus there was obtained a hot-dip galvanized steel sheet (or a hot-dip galvannealed steel sheet) as desired. The hot-dip galvanized steel sheet was tested for the structure (kind and amount), mechanical properties, and non-plating parts, in the same way as in Example 1. The results are shown in Table 2.

TABLE 1

| Steel | C (mass %) | Si (mass %) | Mn (mass %) | P (mass %) | S (mass %) | Al (mass %) | Cr (mass %) | Mo (mass %) | Others (mass %) | Value (1) | Value (2) | Note |
|---|---|---|---|---|---|---|---|---|---|---|---|---|
| 1 | 0.05 | 0.01 | 1.53 | 0.005 | 0.006 | 0.043 | 0.21 | 0.11 | | 5.96 | 3.89 | Steels |
| 2 | 0.07 | 0.03 | 1.78 | 0.011 | 0.001 | 0.024 | 0.42 | 0.18 | Ca: 0.0018 | 8.04 | 6.10 | pertaining |
| 3 | 0.14 | 0.01 | 2.09 | 0.008 | 0.011 | 0.051 | 0.09 | 0.42 | | 7.23 | 6.83 | to the present |
| 4 | 0.04 | 0.02 | 1.71 | 0.013 | 0.002 | 0.048 | 0.37 | 0.10 | B: 0.0013 | 7.45 | 4.93 | invention |
| 5 | 0.23 | 0.04 | 1.62 | 0.021 | 0.007 | 0.030 | 0.19 | 0.09 | | 6.09 | 3.66 | Steels for |
| 6 | 0.08 | 0.53 | 1.68 | 0.006 | 0.012 | 0.042 | 0.11 | 0.21 | | 5.91 | 4.44 | comparison |
| 7 | 0.17 | 0.01 | 0.81 | 0.013 | 0.009 | 0.067 | 0.12 | 0.16 | | 3.31 | 3.13 | |
| 8 | 0.06 | 0.01 | 1.75 | 0.009 | 0.005 | 0.031 | 0.73 | 0.25 | | 9.88 | 8.63 | |
| 9 | 0.10 | 0.02 | 1.66 | 0.001 | 0.003 | 0.018 | 0.05 | 0.14 | | 5.42 | 3.36 | |
| 10 | 0.12 | 0.03 | 2.31 | 0.007 | 0.004 | 0.085 | 0.29 | 0.10 | | 8.77 | 5.05 | |
| 11 | 0.04 | 0.02 | 1.82 | 0.005 | 0.008 | 0.062 | 0.24 | 0.18 | Ti: 0.04 | 7.08 | 5.06 | |

Value (1) was calculated from 3Mn + 6Cr + Mo.
Value (2) was calculated from Mn + 6Cr + 10Mo.
Underlined values are outside the range specified in the present invention.

TABLE 2

| Sample No. | Steel No. | Ferrite (area %) | Marten-site (area %) | Other structure (area %) | YP (MPa) | TS (MPa) | El (%) | λ (%) | TS × El (MPa × %) | TS × λ (MPa × %) | Platability | Note |
|---|---|---|---|---|---|---|---|---|---|---|---|---|
| 1 | 1 | 80 | 18 | 2 | 308 | 543 | 40 | 77 | 18120 | 34881 | good | Working |
| 2 | 2 | 77 | 23 | 0 | 333 | 602 | 33 | 49 | 19866 | 29498 | good | examples |
| 3 | 3 | 63 | 37 | 0 | 491 | 814 | 21 | 34 | 17094 | 27676 | good | |
| 4 | 4 | 89 | 11 | 0 | 283 | 464 | 39 | 84 | 18096 | 38976 | good | |
| 5 | 5 | 38 | 41 | 21 | 663 | 788 | 12 | 29 | 9456 | 22852 | good | Comparative |
| 6 | 6 | 74 | 26 | 0 | 381 | 648 | 29 | 46 | 18792 | 29808 | bad | examples |
| 7 | 7 | 52 | 6 | 42 | 424 | 552 | 27 | 39 | 14904 | 21528 | good | |
| 8 | 8 | 82 | 18 | 0 | 357 | 613 | 30 | 63 | 18390 | 38619 | bad | |

TABLE 2-continued

| Sample No. | Steel No. | Ferrite (area %) | Marten-site (area %) | Other structure (area %) | YP (MPa) | TS (MPa) | El (%) | λ (%) | TS × El (MPa × %) | TS × λ (MPa × %) | Platability | Note |
|---|---|---|---|---|---|---|---|---|---|---|---|---|
| 9 | 9 | 72 | 13 | 15 | 360 | 515 | 28 | 58 | 14420 | 29870 | good | |
| 10 | 10 | 69 | 31 | 0 | 511 | 842 | 20 | 27 | 16840 | 22734 | poor | |
| 11 | 11 | 87 | 3 | 10 | 511 | 621 | 25 | 65 | 15525 | 40365 | good | |

λ: Hole expanding ratio (according to JFST 1001-1996)
Platability: good: without non-plating parts, poor: with some non-plating parts, bad: with non-plating parts It is apparent from Table 2 that samples Nos. 1 to 4 (in Working Examples) have a high strength (with tensile strength greater than 450 MPa) and also have a low yield ratio. In addition, they have a good strength-ductility balance (TS×El≧17,000 MPa·%) and are superior in formability. They are free from bare spot. Samples (Nos. 1 and 4) with a high area ratio of ferrite have a good strength-λbalance (TS×λ≧30,000 MPa·%).

By contrast, samples Nos.7, 9, 10, and 11 (in Comparative Examples) have the chemical compositions which are outside the range specified in the present invention. Samples Nos. 5, 7, 9, and 11 contain the microstructure (such as bainite and pearlite) other than ferrite and martensite in an amount exceeding 5 mass %. They are remarkably poor in strength-ductility balance to the samples pertaining to the present invention. On the other hand, sample No. 6 (in Comparative Example), which contains Si in an excess amount, and samples Nos. 8 and 9 (in Comparative Example), which contain Mn, Cr, and Mo in an amount outside the range specified in the present invention, suffered non-plating.

[Effect of the invention] The hot-dip galvanized steel sheet of the present invention has a high strength (with a tensile strength of 440–780 N/mm$^2$) and a low yield ratio, and superior in strength-ductility balance and formability. It is free from bare-spot and superior in platability. When used for automotive members, it greatly contributes to weight reduction and rust prevention, without its plating layer peeling off during forming. The process of the present invention permits easy and efficient production of the above-mentioned high-strength hot-dip galvanized steel sheet.

What is claimed is:

1. A hot-dip galvanized steel sheet comprising a base steel sheet and a layer of hot-dip galvanizing formed thereon, the base steel sheet having a chemical composition comprising C: 0.02–0.20 mass %, Mn: 1.5–2.40 mass %, Cr: 0.03–1.50 mass %, Mo: 0.03–1.50 mass %, 3Mn+6Cr+Mo: no more than 8.1 mass %, Mn+6Cr+10Mo: no less than 3.5 mass %, Al: 0.010–0.150 mass %, Ti: 0.01 mass % or less, Si: 0.04 mass % or less, P: 0.060 mass % or less, S: 0.030 mass % or less, and Fe as the principal component, wherein the base steel sheet has a composite microstructure that includes mainly ferrite and martensite.

2. A hot-dip galvanized steel sheet as defined in claim 1, wherein the composite microstructure comprises a structure other than ferrite and martensite in an area ratio lower than 5%.

3. A hot-dip galvanized steel sheet as defined in claim 2, wherein the composite microstructure contains ferrite in an area ratio of more than 50%.

4. An automotive part produced from the hot-dip galvanized steel sheet defined in claim 1.

5. A process for producing a hot-dip galvanized steel sheet the process comprising casting a slab of steel having the chemical composition defined in claim 1, forming the slab of steel into a steel sheet, and hot-dip galvanizing the steel sheet.

* * * * *